US007270571B1

(12) United States Patent
Huang et al.

(10) Patent No.: US 7,270,571 B1
(45) Date of Patent: Sep. 18, 2007

(54) CABLE CORD LOCATING ELEMENT

(75) Inventors: Ching-Yuan Huang, Hsing-Dein (TW); Huo-I Ho, Penang (MY)

(73) Assignee: Joinsoon Electronics Mfg. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/582,341

(22) Filed: Oct. 18, 2006

(30) Foreign Application Priority Data

Aug. 25, 2006 (TW) ..... 95215084 U

(51) Int. Cl.
*H01R 13/648* (2006.01)

(52) U.S. Cl. ..... 439/607; 439/701; 439/942

(58) Field of Classification Search ..... 439/607, 439/701, 942, 610, 660
See application file for complete search history.

(56) References Cited

U.S. PATENT DOCUMENTS 4,993,968 A * 2/1991 Guletsky et al. ..... 439/492
5,120,235 A * 6/1992 Kashiwa ..... 439/405
5,380,220 A * 1/1995 Okabe ..... 439/456
6,293,829 B1 * 9/2001 Qiao et al. ..... 439/719
6,648,697 B2 * 11/2003 Yang ..... 439/701
6,652,325 B2 * 11/2003 Tharp et al. ..... 439/660
6,802,744 B2 * 10/2004 Chiang ..... 439/701

* cited by examiner

*Primary Examiner*—Hien Vu
(74) *Attorney, Agent, or Firm*—Rosenberg, Klein & Lee

(57) ABSTRACT

A cable core locating element includes a base formed of a plurality of clamping slots for clamping one of many cores of a cable each, with a free end of the core projected from a front side of the base. When the free ends of the forward projected cores are stripped and the base is assembled to an electronic connector, the stripped free end of each of the cores is lapped over and soldered to a wire soldering section of one of many terminals of the electronic connector, so as to electrically connect the electronic connector to the cable.

3 Claims, 5 Drawing Sheets

CABLE CORD LOCATING ELEMENT

BACKGROUND OF THE INVENTION

1. Field of the Invention

The present invention relates to a cable core locating element, and more particularly to a cable core locating element for orderly and stably locating cores of a cable to be soldered to terminals of an electronic connector, so as to facilitate subsequent terminal soldering process in producing the electronic connector.

2. Description of the Prior Art

Electronic connectors that are currently employed in electronic signal transmission, such as high-definition multimedia interface (HDMI) and universal serial bus (USB) interface, typically include a terminal holding body, on which a plurality of terminals are mounted with a rear section of each of the terminals being separately soldered to one of many cores of a cable. Thereafter, the terminal holding body and the cable are enclosed in a pair of metal cases, and a rear part of the metal cases is covered with an insulating housing to complete the electronic connector.

There are usually 19 cores included in one cable. When an insulating sheath of the cable is stripped, the cores are disorderly exposed to an open space. To solder the cores of the cable to the terminals of the connector, a front section of each of the cores must be stripped to expose a bare wire thereof, and each of the bare wires is soldered to a corresponding terminal. However, since it is very uneasy to rapidly and clearly distinguish the disordered cores from one another, a lot of time and labor is needed to correctly solder the bare wires of the cores to the terminals, bringing confusions to the production of the electronic connector. Moreover, cores that have been soldered to corresponding terminals are subjected to undesired pull and breaking in the process of distinguishing and soldering the disordered cores, resulting in reduced good yield and poor quality of the produced electronic connectors.

It is therefore tried by the inventor to develop a novel cable core locating element to overcome the problems in manufacturing of the electronic connectors.

SUMMARY OF THE INVENTION

A primary object of the present invention is to provide a cable core locating element, so that the cores of a cable may be easily soldered to terminals of an electronic connector.

To achieve the above and other objects, the cable core locating element of the present invention includes a base formed of a plurality of clamping slots for clamping one of many cores of a cable each, with a stripped free end of the core projected from a front side of the base. When the base is assembled to an electronic connector, the stripped free end of each of the cores is lapped over and soldered to a wire soldering section of one of many terminals of the electronic connector, so as to electrically connect the electronic connector to the cable.

With the cable core locating element, disordered cable cores may be orderly and stably located in place to facilitate subsequent manufacturing processes, including core stripping and soldering of stripped cores to terminals of the electronic connector, so as to reduce the time and labor costs needed to produce the electronic connector.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
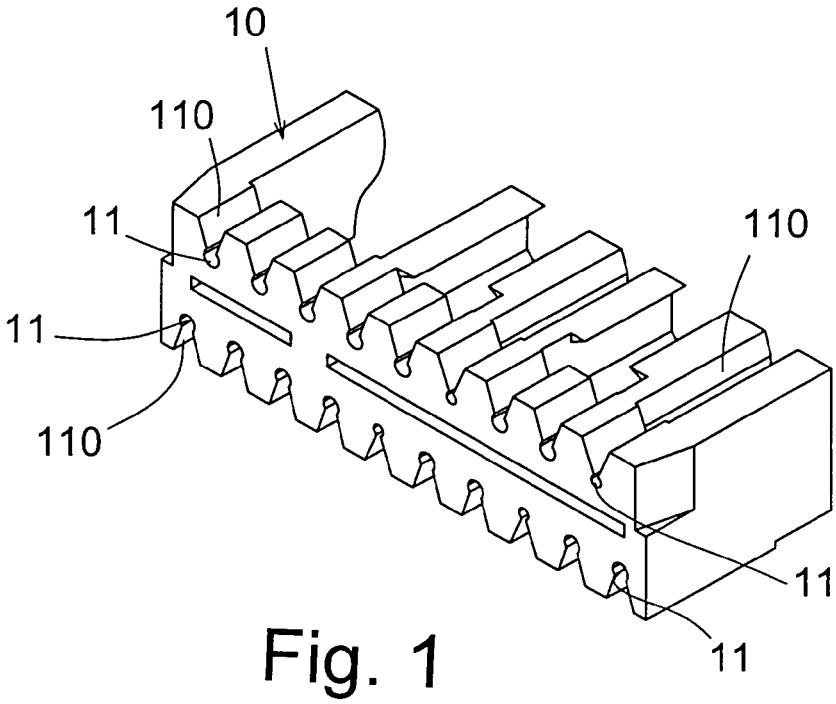
FIG. 1 is a front perspective view of a cable core locating element according to a preferred embodiment of the present invention.

Please refer to FIGS. 1 through 7. A cable core locating element according to a preferred embodiment of the present invention includes a base 10 with a plurality of clamping slots 11, in each of which one of many cores 21 of a cable 20 may be clamped with a free end 211 of the clamped core 21 projected from a front side of the base 10. Each of the forward projected free ends 211 of the clamped cores 21 is then stripped to remove an insulating skin 211*a* and expose a bare wire 211*b* thereof. When the base 10 is assembled to an electronic connector 30, each of the stripped free ends 211 of the cores 21 is lapped over and soldered to a wire soldering section 311 on each of many terminals 31 of the electronic connector 30, so that the electronic connector 30 and the cable 20 are electrically connected to each other.

Figure 2:
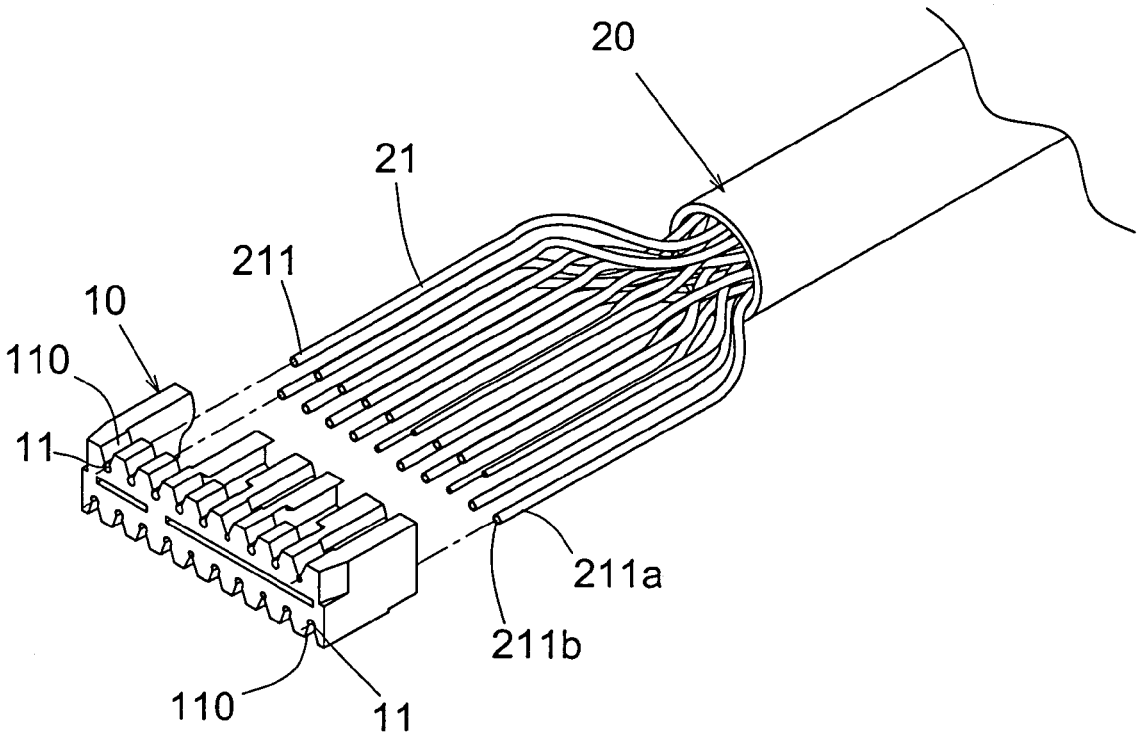
FIG. 2 is an exploded front perspective view showing the cable core locating element of FIG. 1 separated from cores of a cable.

The base 10 shown in FIGS. 1 and 2 is made of an insulating material. Each of the clamping slots 11 has a generally V-sectioned profile and accordingly an expanded opening, via which the core 21 could be easily guided into the clamping slot 11 and firmly held therein. In the illustrated base 10, the clamping slots 11 are formed at two vertically opposite sides, namely, an upper and a lower side, of the base 10. In a modified embodiment, the clamping slots 11 are provided at only one of the two vertically opposite sides of the base 10. In the present invention, the clamping slots 1 1 may be formed at one or two sides of the base 10 without specific limitation.

Figure 3:
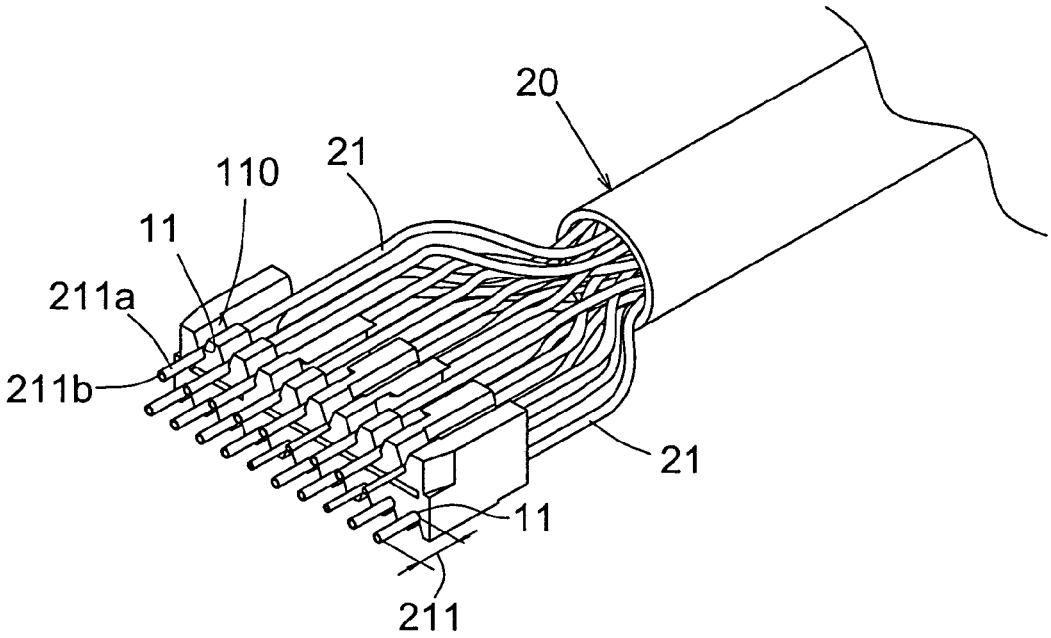
FIG. 3 is an assembled front perspective view showing the cable core locating element of FIG. 1 with cores of the cable separately clamped in clamping slots on a base of the cable core locating element.
Figure 4:
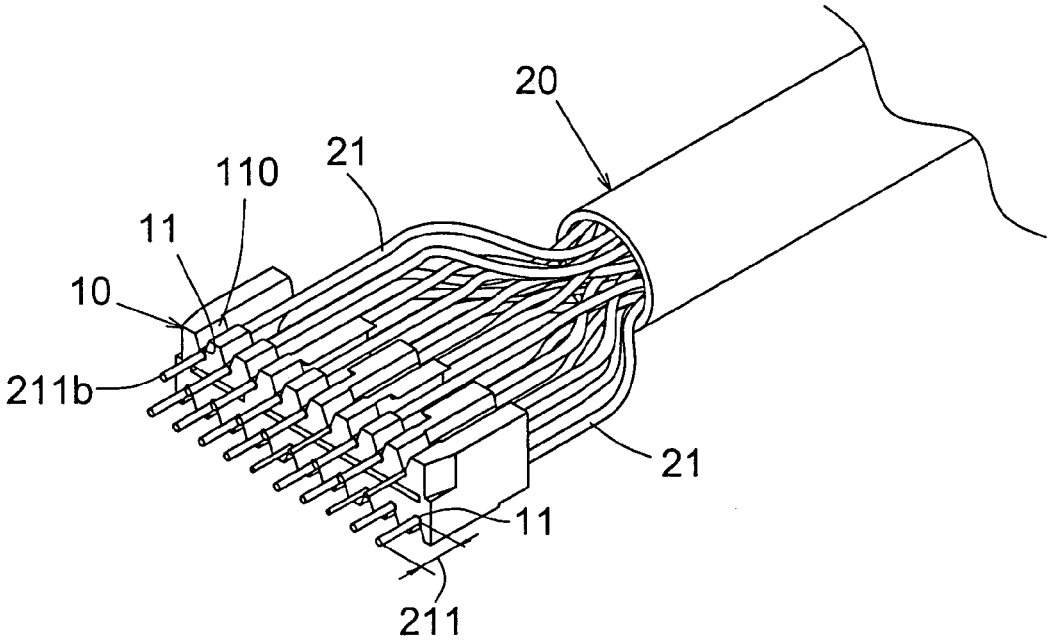
FIG. 4 is similar to FIG. 3 with free ends of the cable cores projected from the cable core locating element being stripped to expose bare wires.
Figure 5:
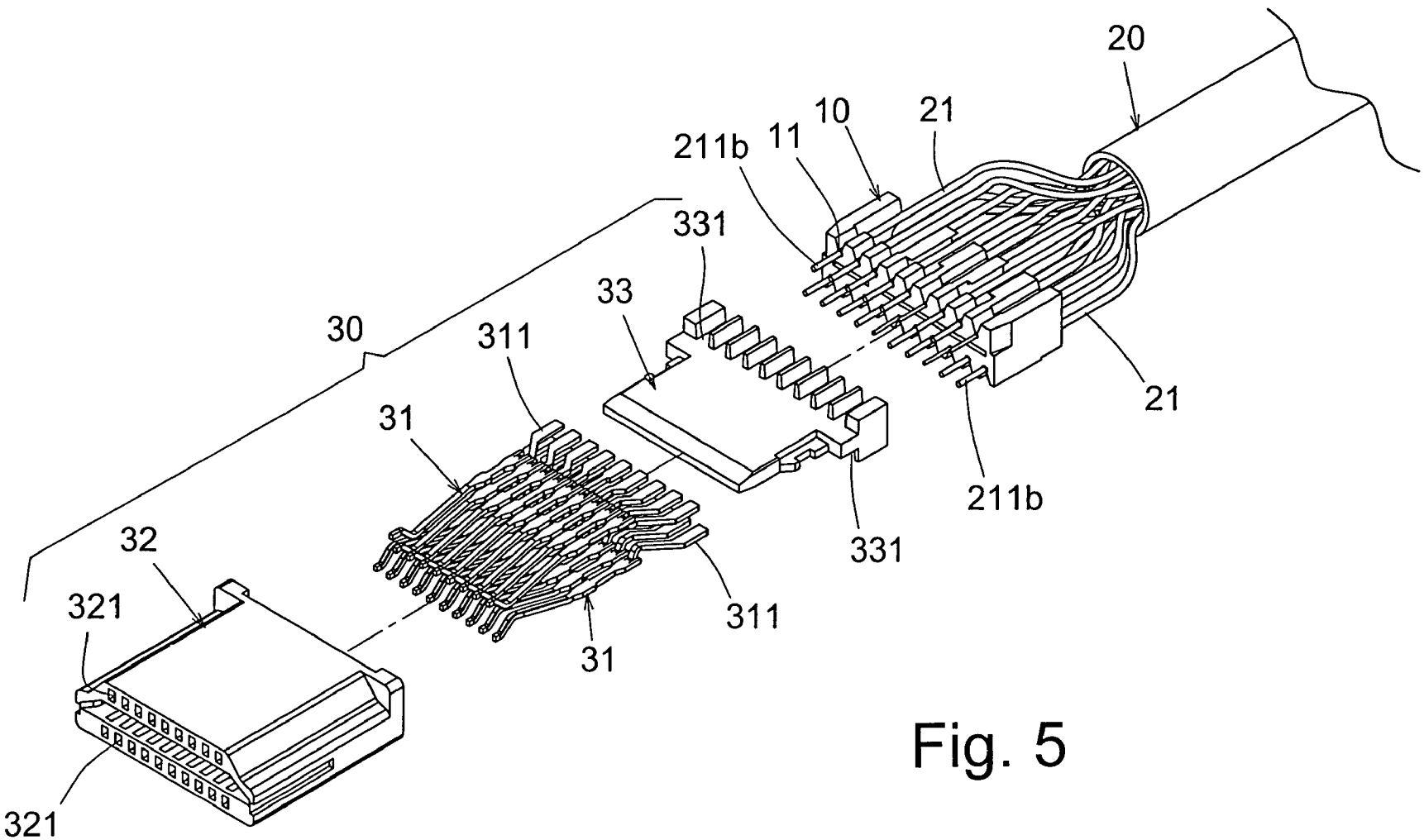
FIG. 5 is an exploded front perspective view of some parts of an electronic connector separated from the cable of FIG. 4.
Figure 6:
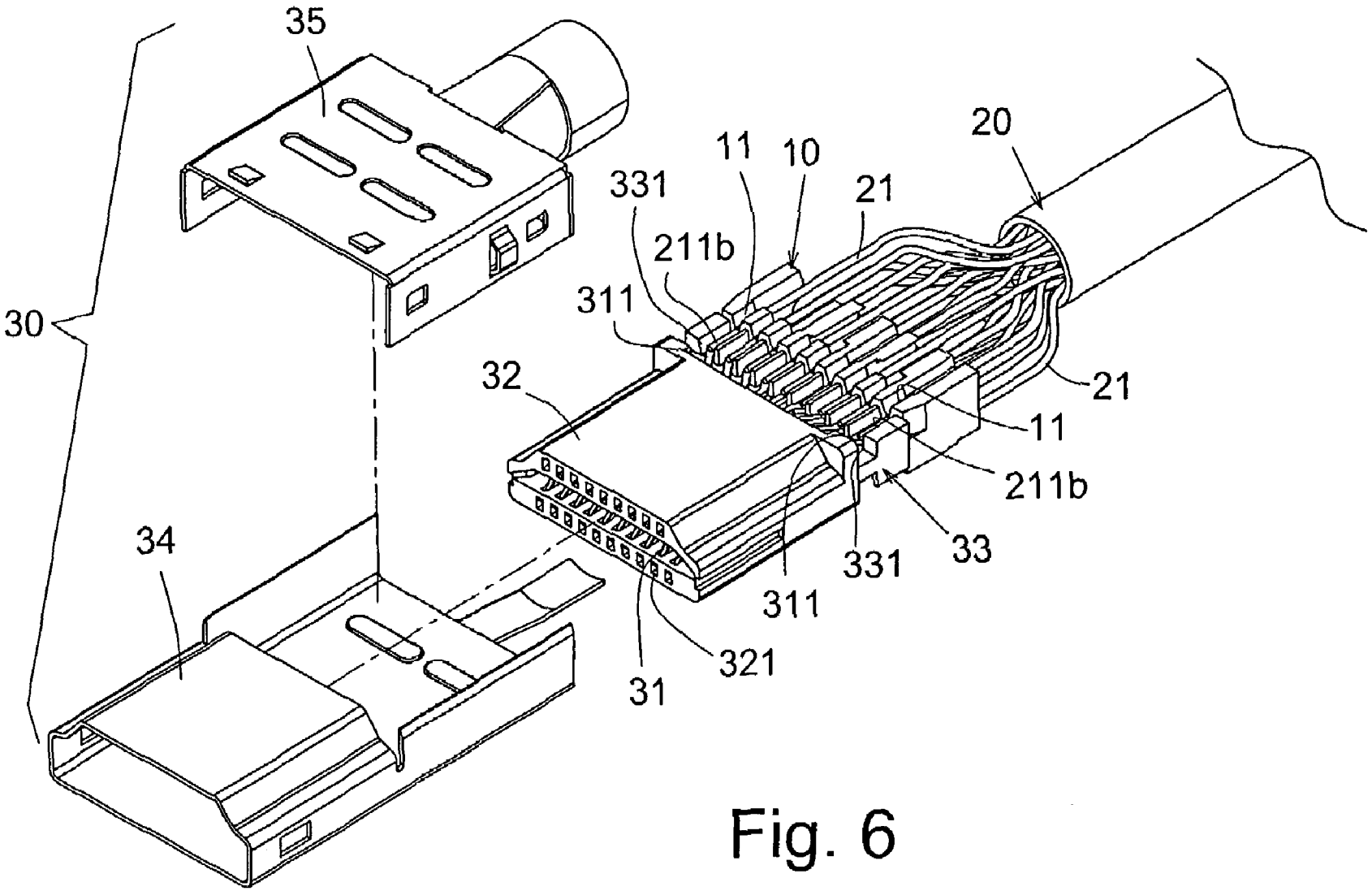
FIG. 6 is an exploded perspective view showing the assembly of electronic connector and cable of FIG. 5 is to be enclosed in an upper and a lower metal shielding case.

To use the cable core locating element of the present invention, first strip off the insulating sheath at a front section of the cable 20, so as to expose a determined length of the cores 21, as shown in FIG. 2. Then, separately dispose the cores 21 into the clamping slots 11 one at a time, so that the free ends 211 of the cores 21 are forward projected from a front side of the base 10, as shown in FIG. 3. At this point, a semi-automatic pulse cutting machine or laser cutting machine is used to cut the insulating skin 211*a* at the free end 211 of each core 21 projected from the clamping slot 11 of the base 10, and the cut insulating skin 211*a* is stripped off to expose a length of bare wire 211*b* of the core 21, as shown in FIG. 4. Thereafter, as shown in FIGS. 5 and 6, dispose the base 10 in an electronic connector 30, such that each of the bare wires 211*b* of the cores 21 being held to the base 10 is lapped over a wire soldering section 311 on one of many terminals 31 of the electronic connector 30; and then lay a tin foil on the bare wires 211*b*, and use a semi-automatic soldering machine to solder the bare wires 211*b* of the cores 21 to the wire soldering sections 311 of the terminals 31. In the above-described stripping and soldering processes, a semi-automatic pulse or laser cutting machine and a semi-automatic soldering machine are employed. However, it is understood the stripping and soldering processes may also be completed in different manners and using other types of machines without being limited to any specific way.

Figure 7:
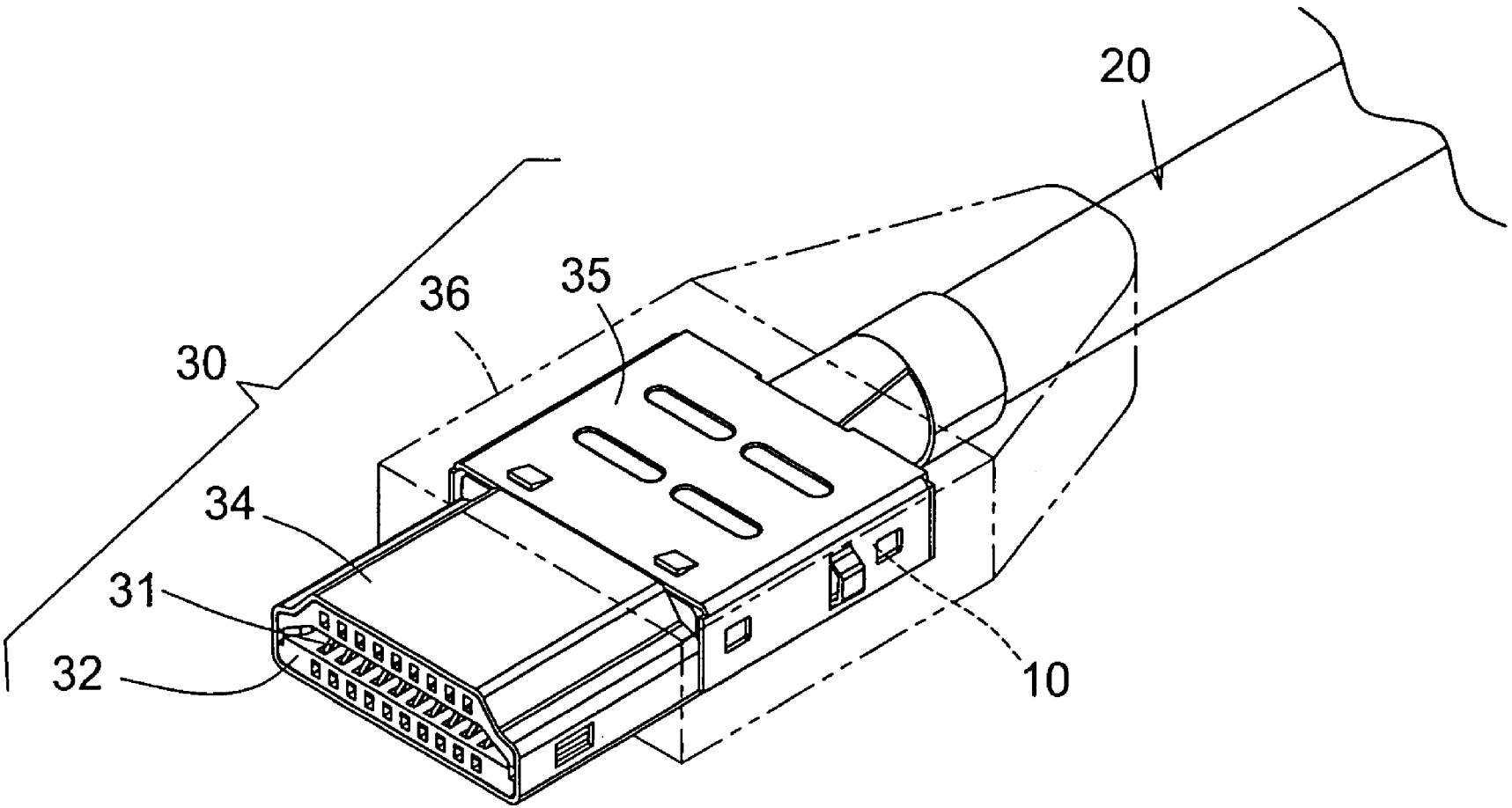
FIG. 7 is an assembled front perspective view of a completed electronic connector employing the cable core locating element of the present invention.

The cable core locating element of the present invention may be employed in an electronic connector 30 as shown in FIG. 5. The electronic connector 30 may include a terminal holding body 32 made of an insulating material and being formed of an upper and a lower row of terminal cavities 321 axially extended through the terminal holding body 32 for receiving one terminal 31 each, and a terminal carrier 33 inserted into a space existed between rear ends of the two rows of terminals 31. The terminal carrier 33 is formed at upper and lower rear ends with a plurality of parallelly partitioned spaces 331 for supporting and receiving one wire soldering section 311 each. After the cores 21 of the cable 20 on the base 10 are soldered to the wire soldering sections 311 of the terminals 31, the terminal holding body 32 and the connected wire soldering sections 311 and cores 21 are enclosed in a lower and an upper metal shielding case 34, 35, as shown in FIGS. 6 and 7. Thereafter, an insulating housing 36 is further provided to house a rear outer surface of the connected lower and upper metal shielding cases 34, 35 to complete the electronic connector 30. It is understood the electronic connector 30 may be of any configuration and specification, such as a HDMI-type connector as shown in FIG. 7, or a conventional USB-type connector, or any other types of connectors without special limits.

The cable core locating element of the present invention is structurally characterized in the base 10 with a plurality of clamping slots 11, in which a plurality of initially disordered cores 21 may be orderly and stably disposed and located in place, so that the subsequent core stripping and terminal soldering processes could be easily and rapidly performed to enable enhanced product quality at reduced manufacturing time and labor cost.

The present invention has been described with a preferred embodiment thereof and it is understood that many changes and modifications in the described embodiment, including the structure and shape thereof, can be carried out without departing from the scope and the spirit of the invention that is intended to be limited only by the appended claims.

What is claimed is:

1. A cable core locating apparatus, comprising:

a terminal carrier, a metal shield case and a base having a plurality of substantially V-shaped clamping slots consistently formed throughout said base thereby defining a plurality of passages for receiving and clamping each one of a plurality of cores of a cable, wherein a free end of each one of said plurality of cores project outwardly extending beyond an outer edge of a front side of said base;

whereby when said base is assembled to a high-definition multimedia interface connector having a body receiving said terminal carrier therein, a bare wire of said free end of each one of said cores abuts against each one of a corresponding wire soldering end of a plurality of terminals of said high-definition multimedia interface connector in overlying relation, said free ends of said bare wires and said terminals being positioned on top and bottom sides of said terminal carrier, each one of said bare wires and said wire soldering ends being soldered together, so that said high-definition multimedia interface connector and said cable are electrically connected.

2. The cable core locating apparatus as claimed in claim 1, wherein said plurality of clamping slots of said base are formed on two opposing sides.

3. The cable core locating apparatus as claimed in claim 1, wherein said plurality of clamping slots of said base are formed on one side of said base.

* * * * *